US006491371B1

(12) United States Patent
Berg et al.

(10) Patent No.: US 6,491,371 B1
(45) Date of Patent: Dec. 10, 2002

(54) INK BLOTTER FOR AN INK JET PRINTER MAINTENANCE STATION PROVIDING INCREASED INK CARRYING CAPACITY

(75) Inventors: Richard H. Berg, Rochester, NY (US); Christopher A. O'Dell, Caledonia, NY (US); Steven J. Dietl, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/594,681

(22) Filed: Jun. 16, 2000

(51) Int. Cl.[7] ..... B41J 2/165
(52) U.S. Cl. ..... 347/36
(58) Field of Search ..... 347/36, 33

(56) References Cited

U.S. PATENT DOCUMENTS

| | | | | |
|---|---|---|---|---|
| 4,746,938 A | | 5/1988 | Yamamori et al. | |
| 4,853,717 A | | 8/1989 | Harmon et al. | |
| 4,855,764 A | | 8/1989 | Humbs et al. | |
| 5,151,715 A | | 9/1992 | Ward et al. | |
| 5,250,962 A | | 10/1993 | Fisher et al. | |
| 5,339,102 A | | 8/1994 | Carlotta | |
| 5,500,659 A | | 3/1996 | Curran, Jr. et al. | |
| 5,548,310 A | | 8/1996 | Binnert et al. | |
| 5,659,341 A | | 8/1997 | Kinas | |
| 5,821,955 A | * | 10/1998 | Waschhauser | 347/36 |
| 5,943,071 A | | 8/1999 | Premnath | |
| 6,130,684 A | | 10/2000 | Premnath et al. | |

FOREIGN PATENT DOCUMENTS

| | | | | |
|---|---|---|---|---|
| JP | 6-143597 A | * | 5/1994 | 347/33 |

OTHER PUBLICATIONS

POREX Porous Products Group, POREX® Porous Plastics, Assemblies and Tolerances [online]. Copyright 2002 Porex Corporation [retrieved Jun. 21, 2002]. Retrieved from the Internet: <URL: http://www.porex.com/english/porous/attechinfo.asp>.*

* cited by examiner

*Primary Examiner*—Huan Tran
(74) *Attorney, Agent, or Firm*—Oliff & Berridge, PLC

(57) ABSTRACT

An improved ink blotter method system usable in a maintenance station of an ink jet printer including wiper blades positioned to clean the printheads and an assembly of absorbent materials to clean the wiper blades.

20 Claims, 6 Drawing Sheets

INK BLOTTER FOR AN INK JET PRINTER MAINTENANCE STATION PROVIDING INCREASED INK CARRYING CAPACITY

BACKGROUND OF THE INVENTION

1. Field of Invention

This invention relates to maintenance stations for ink jet printing apparatus.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

The ink ejecting orifices of an ink jet printer need to be maintained, for example, by periodically cleaning the orifices when the printer is in use, and/or by capping the printhead when the printer is out of use or is idle for extended periods. Capping the printhead is intended to prevent the ink in the printhead from drying out. The cap provides a controlled environment to prevent ink exposed in the nozzles from drying out.

A printhead may also need to be primed before initial use, to ensure that the printhead channels are completely filled with the ink and contain no contaminants or air bubbles. After significant amounts of printing, and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938, while the removal of gas from the ink reservoir of a printhead during printing is described in U.S. Pat. No. 4,679,059.

The priming operation, which usually involves either forcing or drawing ink through the printhead, can leave drops of ink on the face of the printhead. As a result, ink residue builds up on the printhead face. This ink residue can have a deleterious effect on the print quality. Paper fibers and other foreign material can also collect on the printhead face while printing is in progress. Like the ink residue, this foreign material can also have deleterious effects on print quality.

The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent discloses providing an ink jet printer with a washing unit which, at the end of the printing operation, directs water at the face of the printhead to clean the printhead before it is capped.

SUMMARY OF THE INVENTION

In one exemplary embodiment of the maintenance station according to this invention, one or more printheads are mounted on a translatable carriage and moves with the carriage. When the printer is printing, the translatable carriage is located in a printing zone, where the one or more printheads can eject ink onto a recording medium. When the printer is placed into a non-printing mode, the translatable carriage is translated to the maintenance station located outside and to one side of the printing zone. Once the cartridge is translated to the maintenance station, various maintenance functions can be performed on the one or more printheads of the printer depending on the rotational position of a cam shaft in the maintenance station. The cam shaft engages and drives the hardware that in turn operates the individual maintenance functions.

Rotating the cam shaft activates various maintenance mechanisms of the maintenance station, including a wiper blade platform and a cap carriage. The wiper platform passes across the printhead nozzle faces when the one or more printheads enter the maintenance station and again just before the one or more printheads leave. A location for collecting ink cleared from the nozzles is placed adjacent to the wiper blades. After the one or more printheads arrive at the maintenance station, a vacuum pump is energized, and the cap carriage is elevated to the position where the one or more printhead caps engage the one or more printheads. The one or more printhead caps are mounted on the cap carriage in a capping location. The printheads are primed when a pinch tube mechanism opens one or more pinch tubes connected to the one or more printhead caps. Opening the pinch tubes releases negative pressure created by the vacuum pump. In response, ink is drawn from the one or more printheads into the one or more printhead caps.

Further moving the cam shaft lowers the cap carriage and enables the wiper blades to pass back across the nozzle faces to clean the ink jet printhead nozzles. The vacuum pump is then deenergized, while the cap carriage remains in position so that the one or more printhead caps cap the one or more printheads awaiting the printing mode of the printer. Thus, the one or more printheads remain capped at the maintenance station until the printer is into the printing mode.

These and other features and advantages of this invention are described in or are apparent from the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

Figure 1:
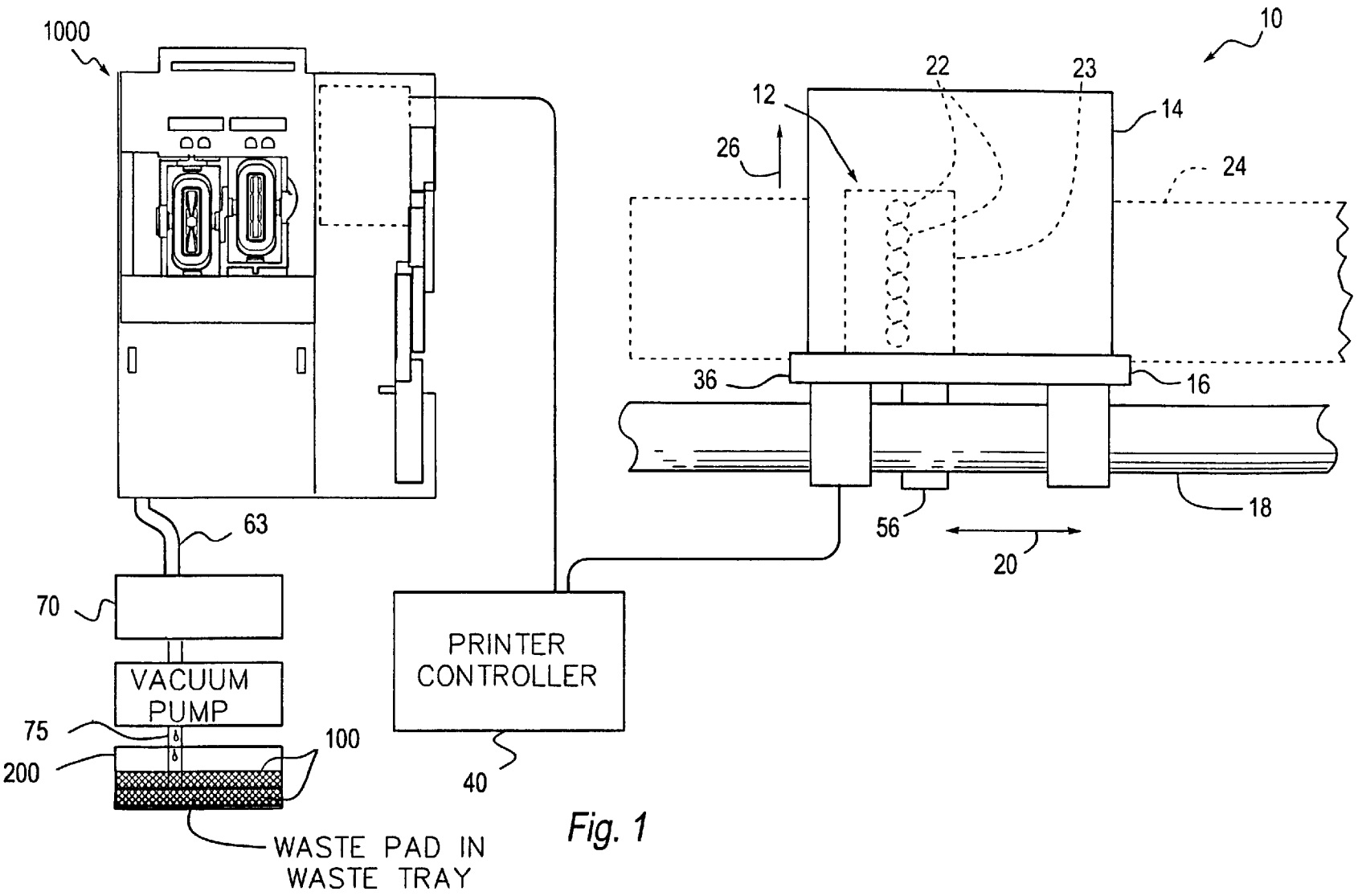
FIG. 1 is a schematic top elevation view of an ink jet printer and a maintenance station according to this invention.

FIG. 1 shows a printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the printer 10 is in a printing mode, the carriage 16 translates or reciprocates back and forth across and parallel to a printing zone 24 (shown in dashed line). Ink droplets are selectively ejected on demand from the printhead nozzles 22 onto a recording medium, such as paper, positioned in the printing zone, to print information on the recording medium one swath or portion at a time. During each pass or translation in one direction of the carriage 16, the recording medium is stationary. At the end of each pass, the recording medium is stepped in the direction of arrow 26 for the distance or the height of one printed swath. U.S. Pat. Nos. 4,571,599 and Re. 32,572, each incorporated herein by reference in its entirety, provide a more detailed explanation of the printhead and the printing operation.

When the printer 10 is no longer in a printing mode, the carriage 16 travels to a maintenance station 1000 spaced from the printing zone 24. With the one or more printheads 12 positioned at the maintenance station 1000, various maintenance functions can be performed on the one or more printheads 12.

Figure 2:
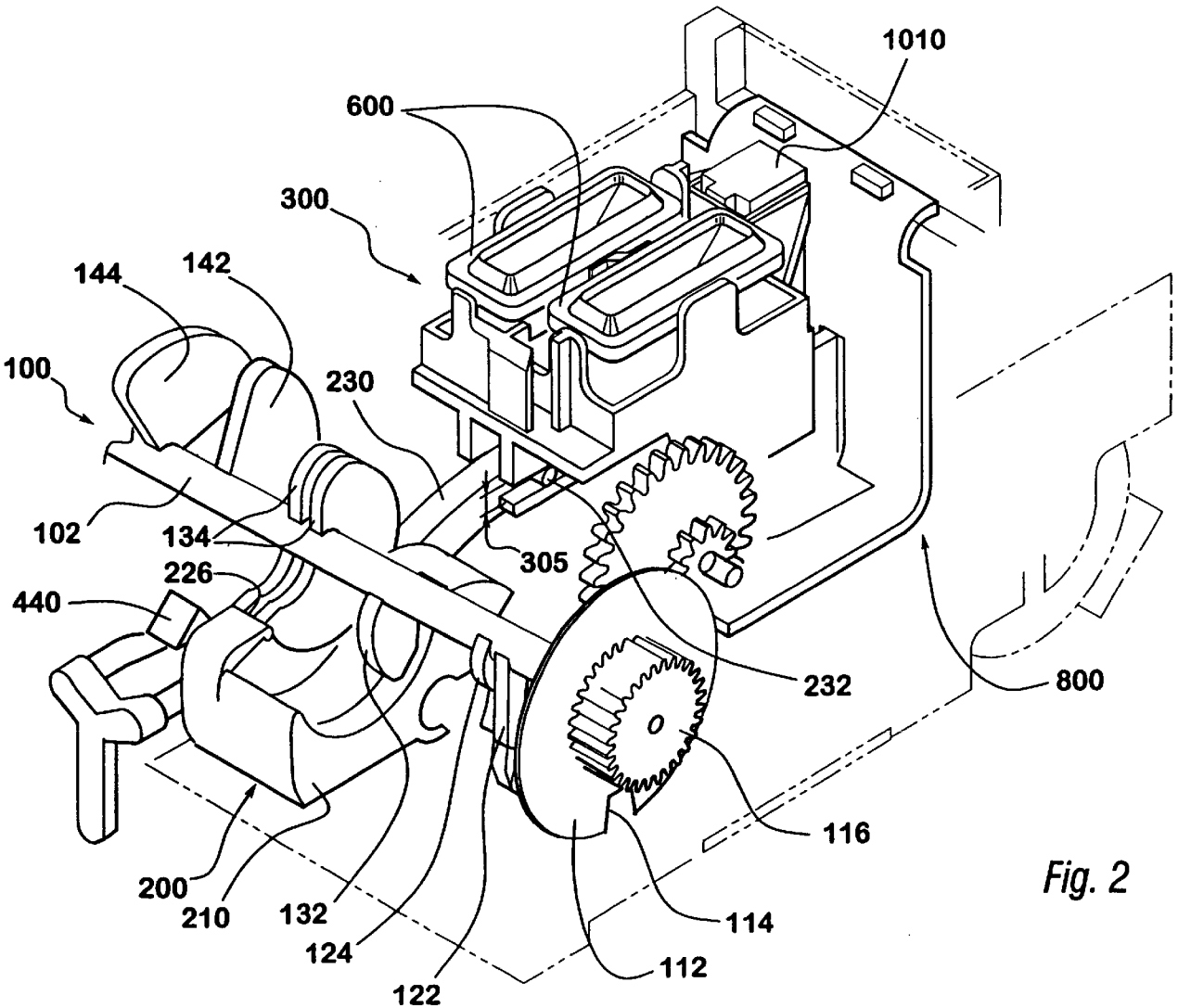
FIG. 2 is a top perspective view of the interior of the maintenance station of FIG. 1.

FIG. 2 is a top perspective view of the maintenance station 1000. As shown in FIG. 2, the maintenance station 1000 includes a cam shaft 100, a cam-actuated lever capping arm 200, and a cap carriage 300 mounted on a guide shaft 1010. In particular, as shown in FIG. 2, and more clearly seen in FIG. 3, the cam shaft 100 includes a driving and control portion 110, a wiper blade drive portion 120, a cam-actuated lever capping arm drive portion 130 and a pinch tube actuating portion 140.

Figure 3:
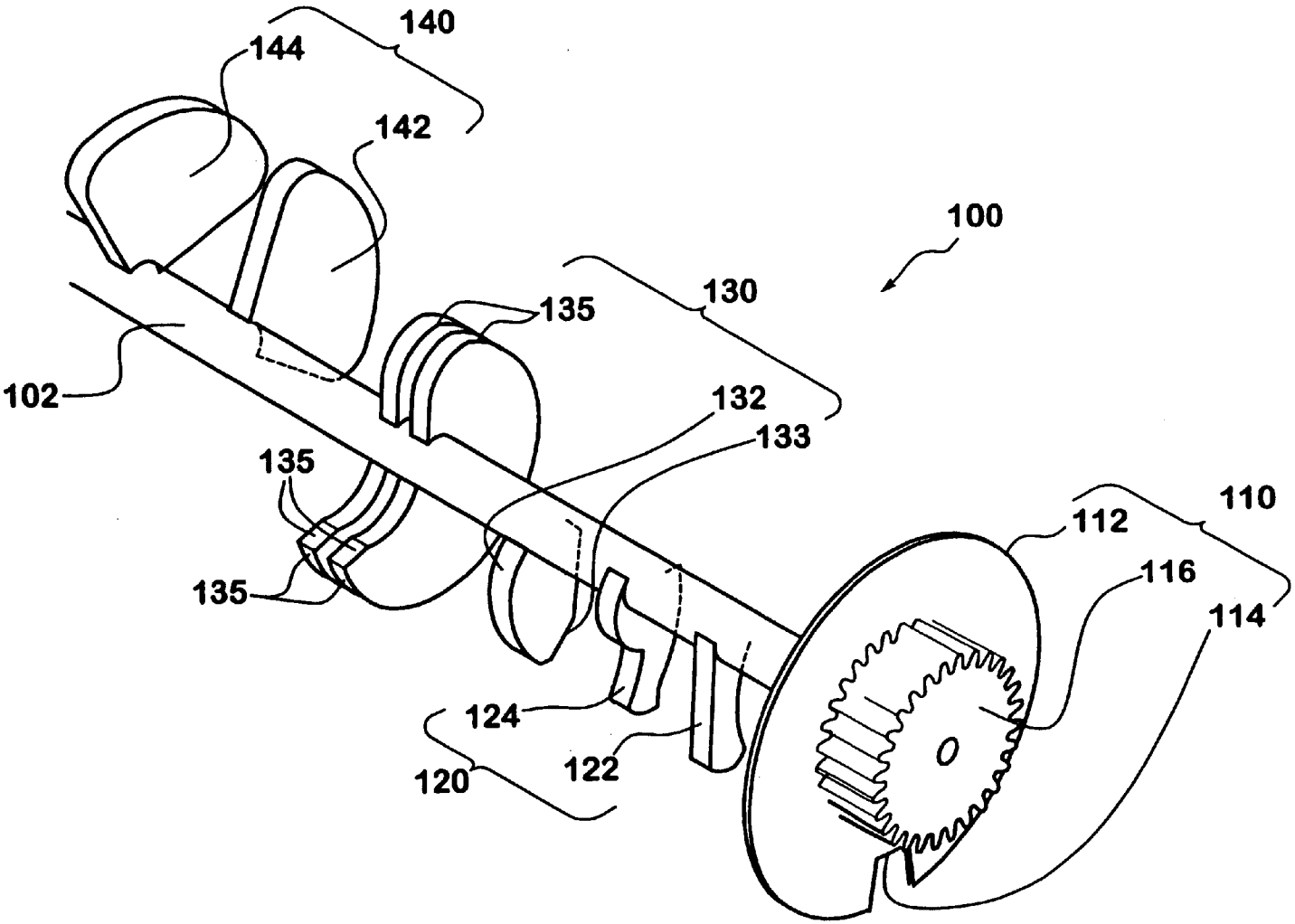
FIG. 3 is a partial perspective view of the cam shaft of FIG. 2.

In various exemplary embodiments, as shown in FIG. 2 and 3, the driving and control portion 110 includes a sensor wheel 112, an optical window 114 formed in the sensor wheel 112, and a main drive gear 116. In operation, a drive gear train (not shown), comprising a drive motor connected to one or more drive gears, engages the main drive gear 116 to drive the cam shaft 100 in counterclockwise and then clockwise directions to actuate the various maintenance functions enabled by the maintenance station 1000. This is described in greater detail in copending U.S. patent application Ser. No. 09/594,694 filed herewith and incorporated herein by reference in its entirety.

In each of an extreme clockwise position of the cam shaft 100 and the extreme counterclockwise position of the cam shaft 100, the optical window 114 is aligned with an optical relay (not shown). Thus, after the drive gear train drives the main drive gear 116 to rotate the cam shaft 100 to the extreme clockwise or counterclockwise position, the optical window 114 formed in the sensor wheel 112 is aligned with the optical relay. In various exemplary embodiments, the optical relay includes a photo-emitter positioned on one side of the sensor wheel 112 and a photo-detector positioned on the other side of the sensor wheel 112. When the optical window 114 is not aligned with the optical relay, the optical relay is in an opened circuit condition.

At the start of a maintenance operation, the sensor wheel 112 is in the extreme clockwise position and the optical window 114 is aligned with the optical relay to close the circuit through the optical relay. As a result, when the one or more printheads 12 are aligned with the maintenance station 1000 and the main drive gear 116 is initially driven in the counterclockwise direction, the optical window 114 is no longer aligned with the optical relay and the optical relay is placed into an open circuit condition. Then, when the sensor wheel 112 reaches its extreme counterclockwise position, the window 114 is again aligned with the optical relay. As a result, the optical relay is placed in the closed circuit condition.

The open and closed circuit conditions of the optical relay are sensed by a printer controller 40. In response, the printer controller 40 stops the gear train engaged with the main drive gear 116 from turning the cam shaft 100 for a predetermined time. In particular, this predetermined time depends on the priming mode currently selected for the maintenance station 1000.

Once the predetermined time has elapsed, the printer controller 40 starts the gear train to drive the main drive gear 116, and thus the cam shaft 100, in the clockwise direction. The cam shaft 100 continues rotating in the clockwise direction until the optical window 114 in the sensor wheel 112 is again aligned with the optical relay to again put the optical relay in a closed circuit condition. When the printer controller 40 again senses the closed circuit condition of the optical relay, the printer controller 40 again stops the gear train from driving the main drive gear 116, and thus the cam shaft 100, in the clockwise direction.

Figure 4:
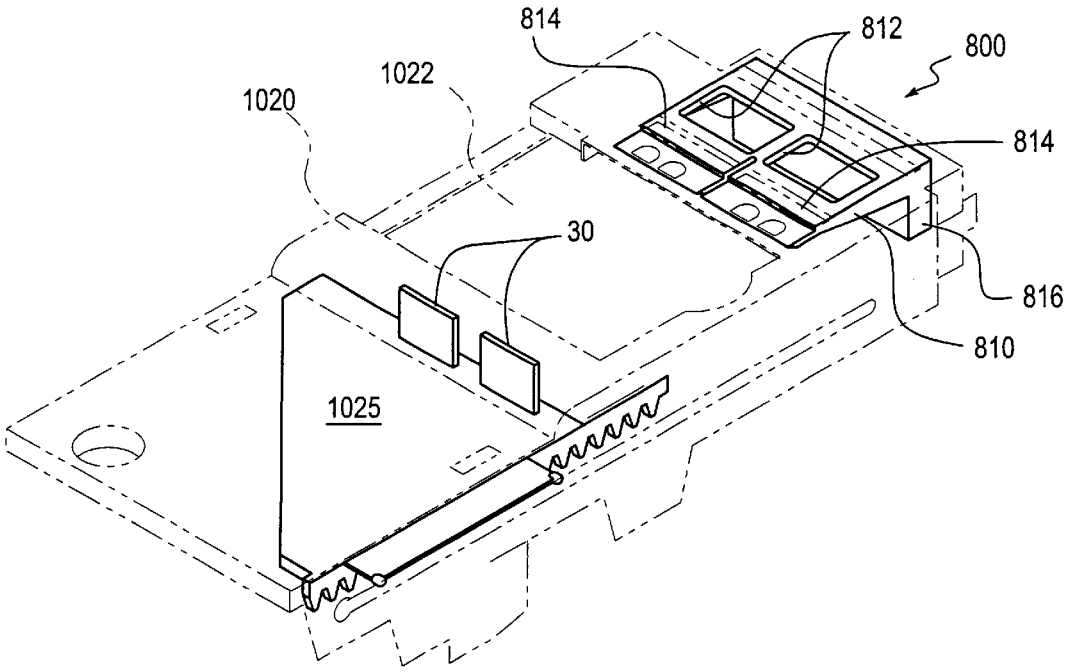
FIG. 4 is a cut-away and expanded perspective view of the wiper blades, ink absorbing material, within the maintenance station of FIG. 1.

In particular, in various exemplary embodiments, when the cam shaft 100 first begins rotating in the counterclockwise direction, the wiper blade portion 120 drives a wiper blade platform 1025, as shown in FIG. 4, from a first position to a second position to pass by the nozzle faces 23 of the one or more printheads 12. Then, when the cam shaft 100 is driven in the clockwise direction, the wiper blade drive portion 120 of the cam shaft 100 lastly drives the wiper blade platform 1025 from the second position back to the first position to wipe the nozzle face 23 of the one or more printheads 12 before the printhead 14 is moved from the maintenance station 1000 to the printing zone 24. The wiper blade platform 1025, and a wiper blade drive mechanism that is positioned between the cam shaft 100 and the wiper blade platform 1025, as well as the operation of the wiper blade drive portion 120, is described in greater detail in the incorporated (Attorney Docket No. 106088) application.

In various exemplary embodiments, after the wiper blade drive portion 120 moves the wiper blade platform 1025 from the first position to the second position, the cam shaft 100 rotates further in the counterclockwise direction. As a result, the cam-actuated lever capping arm drive portion 130 interacts with a cam-actuated lever arm 200 to move a cap carriage 300 from a disengaged position to an engaged position. In the engaged position, one or more printhead caps 600 carried by the cap carriage 300 engage the one or more printheads 12 as the cam shaft 100 continues to rotate in the counterclockwise direction. Similarly, when the cam shaft 100 is driven in the clockwise direction, the cam-actuated lever capping arm drive portion 130 interacts with the cam-actuated lever arm 200 to move the capping carriage 300 from the engaged position to the disengaged position before the wiper blade drive portion 120 moves the wiper blade platform 1025 from the second position back to the first position. The structure and operation of the printhead caps 600 are described in greater detail in copending U.S. patent applications Ser. No. 09/594,6682 and 09/594,691, each filed herewith and incorporated herein by reference in its entirety.

Likewise, after the cam-actuated lever capping arm drive portion 130 moves the capping station 300 from the disengaged position to the engaged position, the cam shaft 100 rotates further in the counterclockwise direction. As a result, the pinch tube actuating portion 140 actuates one or more pinch tubes 63 to apply a negative pressure to the one or more printheads cap 600 mounted on the cap carriage 300. The structure and operation of the pinch tubes 63 and a pinch tube mechanism is described in greater detail in copending U.S. patent application Ser. No. 09/594,680 filed herewith and incorporated herein by reference in its entirety.

In the exemplary embodiments shown in FIGS. 2 and 3, the cap carriage 300 carries two printhead caps 600, each having a separate pinch tube 13. Accordingly, the pinch tube actuation portion 140 includes a first pinch tube actuating cam 142 and a second pinch tube actuation cam 144. The first pinch tube actuating cam 142 actuates a first pinch mechanism to pinch a first tube 63 connected to the first one of the two printhead caps 600. Similarly, the second pinch tube actuating cam 144 actuates a second pinch mechanism to pinch a second tube 63 connected to the second one of the two printhead caps 600.

The cam shaft 100 then continues to rotate in the counterclockwise direction until the cam shaft 100 reaches the extreme counterclockwise position. The printer controller 40, based on the signal from the optical relay generated when the optical window 114 is aligned with the optical relay, maintains the cam shaft 100 in the extreme counterclockwise position for one of the predetermined times.

Then, after the predetermined time has elapsed, the printer controller 63 engages the drive motor of the drive gear train to rotate the cam shaft 100 in the clockwise direction. When the cam shaft 100 is rotated in the clockwise direction, the pinch tube actuation portion 140 again interacts with the one or more pinch tubes 63 before the cap carriage 300 is moved from the engaged position to the disengaged position by the cam-actuated lever capping arm drive portion 130, which occurs before the wiper blade drive portion 120 moves the wiper blade platform 1025 from the second position to the first position.

As shown in FIGS. 2 and 3, the various elements of the cam shaft drive portion 110, the wiper blade drive portion 122, the cam-actuated lever capping arm drive portion 130 and the pinch tube actuation portion 140 are mounted on a shaft 102 of the cam shaft 100. As shown in FIGS. 2 and 3, in various exemplary embodiments, the wiper blade drive portion 120 includes a forward wiper driving cam 122 that is used to drive the wiper blade platform 1025 from the first position to the second position, and a reverse wiper blade driving cam 124 that is used to drive the wiper blade platform 1025 from the second position back to the first position.

In the exemplary embodiments shown in FIGS. 2 and 3, the cam-actuated lever capping arm drive portion 130 includes a hold-down cam 132 and one or more capping cams 134. The structure and operation of the cam-actuated lever capping arm drive portion 130 and the cam-actuated lever capping arm 200 as described in greater detail in copending U.S. patent application Ser. No. 09/721,954 filed herewith and incorporated herein by reference in its entirety.

Figure 5:
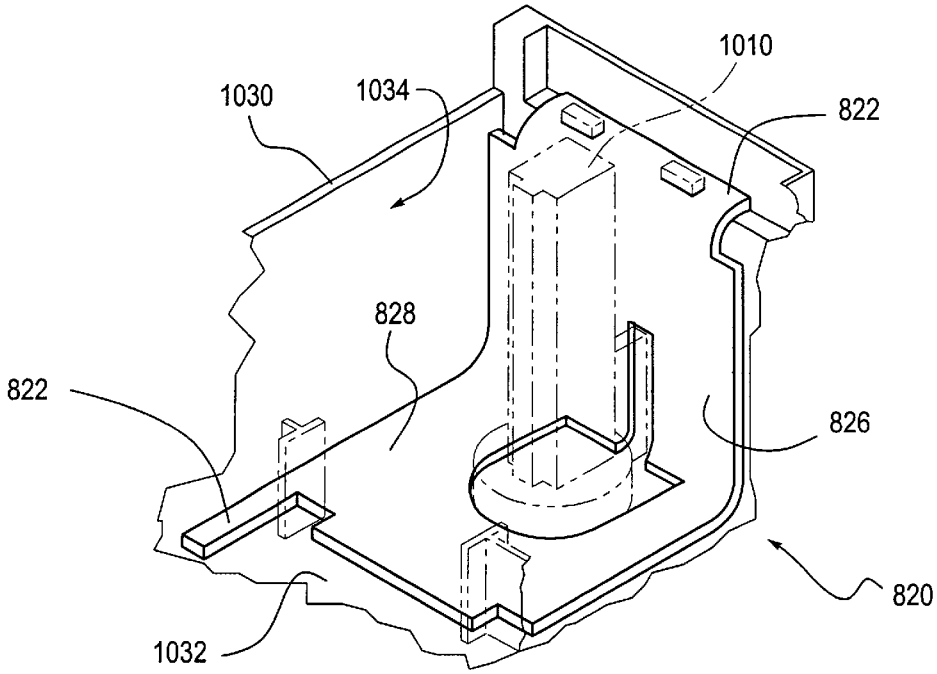
FIG. 5 is a perspective view of the ink absorbing material within the maintenance station of FIG. 1.
Figure 6:
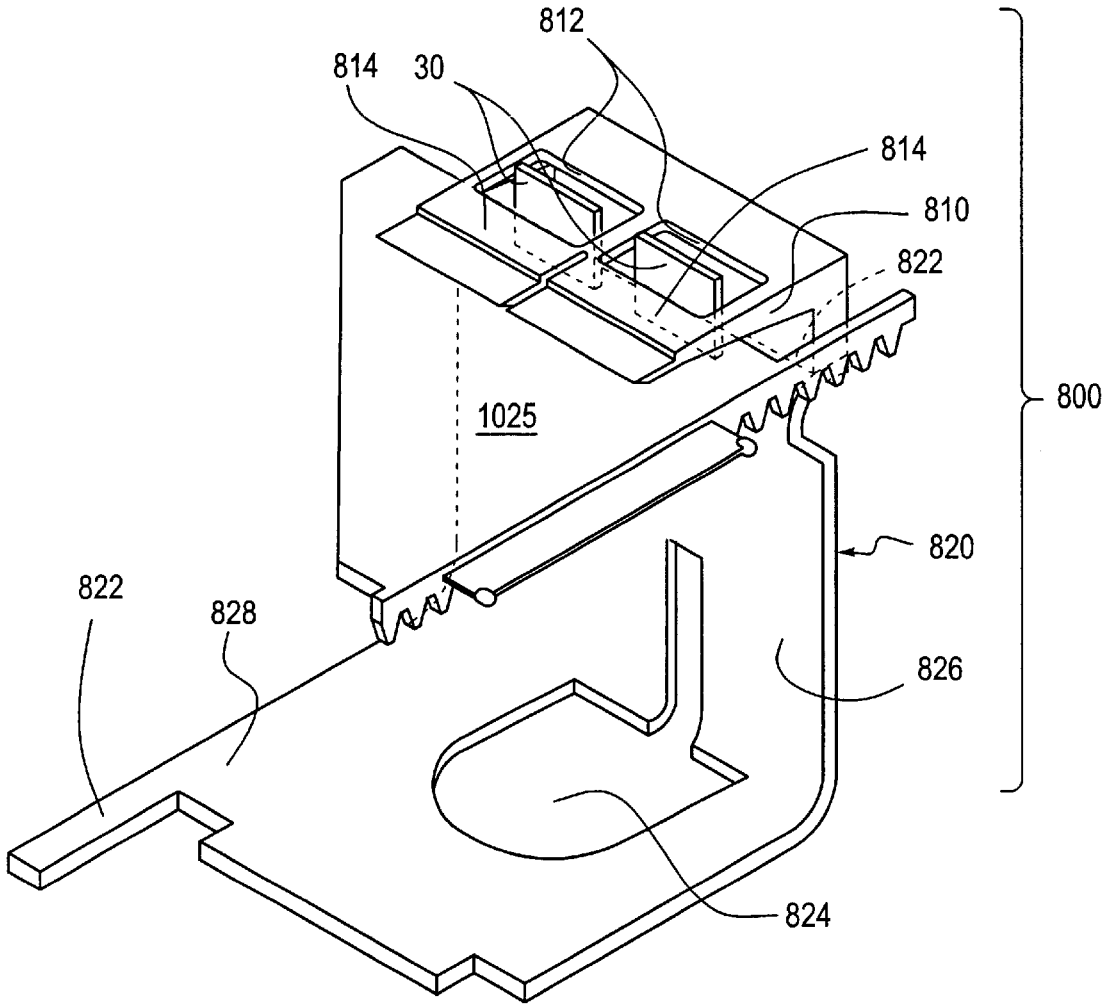
FIG. 6 is a perspective view of the wiper blades, and the ink absorbing material, before the wiper platform is activated, within the maintenance station of FIG. 1.

FIGS. 4–6 show one exemplary embodiment of the improved capacity ink blotter 800 of the maintenance station 1000 according to this invention. In particular, FIG. 4 shows a first portion 810 of the improved capacity ink blotter 800, while FIG. 5 shows a second portion 820 of the high capacity ink blotter 800 and FIG. 6 shows both of the first and second portions 810 and 820 of the high capacity ink blotter 800. Each of FIGS. 4–6 also show the wiper blades 30.

In various exemplary embodiments, as shown in FIG. 4, the first portion 810 of the high capacity ink blotter 800 is positioned in a cover portion 1020 of the ink 5 station 1000. FIG. 4 also shows an opening 1022 provided in the cover portion 1020 of the ink station 1000 and the wiper blade platform 1025 in the second position such that the wiper blade platform 1025 does not extend into the opening 1022. When the wiper blade platform 1025 moves from the second position shown in FIG. 4, to the first position, the wiper blades 30 engage the first portion 810 of the high capacity ink blotter 800.

In particular, when the wiper blade platform 1025 moves from the second position to the first position the wiper blades 30 contact a leading portion 814 of the first portion 810. The leading portion 814 absorbs any liquid ink on the wiper blades 30 and fractionally dislodges any non-liquid ink and/or debris or other contamination from the wiper blades 30. In various exemplary embodiments, as the wiper blade platform 1025 moves from the second position towards the first position, the wiper blades 30 contact a scraper bar 1024. The edge of wiper blades 30 momentarily catches in a notch 1026 of the scraper bar 1024.

As the wiper platform 1025 continues towards the first position, the wiper blades 30 snap out of the notch 1026 and flick waste ink and debris onto a side wall portion of 1034 a bottom portion 1030 of the maintenance station 1000 of the ink station 1000. This waste ink and debris travels down the wall portion 1034 and collects on a spittoon portion 822 of the second portion 820 of the high capacity ink blotter 800. Once deposited on the spittoon, this waste ink and/or debris is absorbed into and gradually spreads out in all directions within the second portion 820 of the high capacity ink blotter 800. The additional surface area provided by the second portion of the high capacity ink blotter 800 increases the ability of the waste ink collected at the spittoon 822 to evaporate.

As the wiper blade platform 1025 reaches the first position, the wiper blades 30 detach from the leading portion 814 and extend through a pair of holes 812 formed in the first portion 810 of the high capacity ink blotter 800. This removes any bending forces from the wiper blades 30 and ensures the wiper blades 30 do not become bent or otherwise distorted due to contact with the first portion 810 of the high capacity ink blotter 800.

In a like manner, when the wiper blades platform 1025 moves from the first position towards the second position, the opposite surfaces of the wiper blades 30 now 5 contact the leading portion 810 as the wiper blades 30 move from the openings 812 toward the opening 1022. As the wiper blade platform 1025 moves from first position towards the second position, the wiper blades 30 again contact the scraper bar 1024. The edge of wiper blades 30 easily pass over a sloped side 1027 of the scraper bar 1024. The sloped side 1027 requires less force to drive the wiper blades 30 up and beyond the scraper bar 1024 as the wiper blades 30 move from the first position to the second position. This creates less stress on the drive motor of the drive gear train and reduces wear on the wiper blade 30. As a result, any liquid ink on these surfaces of the wiper blades 30 is absorbed by the leading portion 814, which also fractionally dislodges any dried ink, debris or other contamination from this surface of the wiper blades 30.

As the wiper blades 30 wipe ink, debris and other contaminations from the nozzle surfaces 23 of the printheads 12, and deposit the removed ink, debris and other contamination on the leading portion 814 of the first portion 810 of the ink blotter 800, the first portion 810 eventually becomes more or less saturated with liquid ink. To improve the capacity of the ink blotter 800, and to absorb liquid ink from the first portion 810, the significantly larger second portion 820 securely contacts the first portion 810.

In various exemplary embodiments, as shown in FIG. 5, the second portion 820 of the high capacity ink blotter 800 is positioned in the bottom portion 1030 of the maintenance station 1000. Thus, when the cover portion 1020 is mounted onto the bottom portion 1030, the first portion 810 of the improved capacity ink blotter 800 is securely pressed against the bottom portion 820. This provides a fluid flow path from the first portion 810 to the second portion 820 of the improved capacity ink blotter 800. This is shown in greater detail in FIG. 6.

It should be appreciated that, in various exemplary embodiments, at least the first portion 810 of the improved capacity ink blotter 800 is formed using an ink absorbing material. In particular, in various exemplary embodiments, POREX is used as the ink absorbing material used to form the first portion 810.

After the one or more printheads 12 have been away from the maintenance station 1000 for a specific length of time, the one or more printheads 12 will be moved by, for example, a carriage motor (not shown) under the control of the printer controller 40 to the maintenance station 1000. Once the one or more printheads 12 are placed adjacent to the maintenance station 1000, the wiper blade platform 1025, carrying the one or more wiper blades 30, is moved from the first position to the second position, as described above.

A leading edge portion 822 of the second portion 820 is positioned adjacent to a trailing edge portion 816 of the first portion 810. The second portion 820 is positioned adjacent to and relative to the bottom portion 1030 of the maintenance station 1000 and extends from the trailing edge portion 816 of the first portion 810 down one side of the bottom portion 820 of the maintenance station 1000 and across a portion of a bottom wall 1032 of the bottom portion 1030 of the maintenance station 1000.

In addition, the second portion 820 has an opening 824 that effectively splits the second portion 820 partially down the middle into subportions 826 and 828. The opening 824 in the second portion 820 aids in absorbing and wicking the waste ink through the first portion 816 into the second portion 820 and through to either of the subportions 826 and 828. The additional capillary wicking action of the second portion 820 allows the first portion 810 of the improved capacity ink blotter 800 to drain the waste ink into the second portion 820. This tends to avoid the waste ink from saturating or overfilling the first portion 810 of the improved capacity ink blotter 800. By allowing the waste ink to drain from the first portion 810 of the improved capacity ink blotter 800 into the second portion 820, the chance that any waste ink will spray from the wiper blades 30 as the wiper blades pass over the leading portion 814 of the first portion 810 the first portion 810 of the improved capacity ink blotter 800 is reduced.

In one exemplary embodiment, many individual systems cooperate to maintain and maximize the useful life of the ink jet printhead 12, and may, for example, take place at a maintenance station. The maintenance station 1000, may be, for example, at one side of the printer, outside the printing zone 24. At the end of a printing operation or termination of the printing mode by the printer 10, the carriage 16 is moved to the maintenance station 1000.

Figure 7:
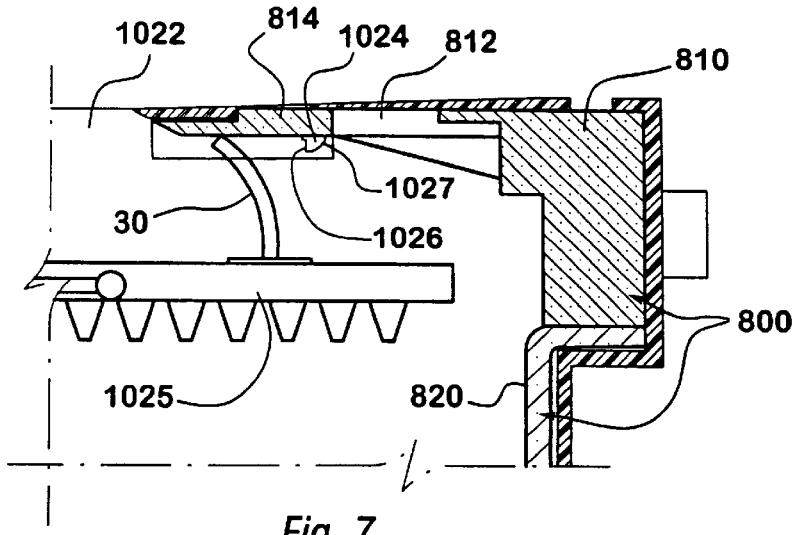
FIG. 7 is a plan perspective view of the cover form the maintenance station of FIG. 1, showing the wiper blade starting its return pass under the ink absorbing material.
Figure 8:
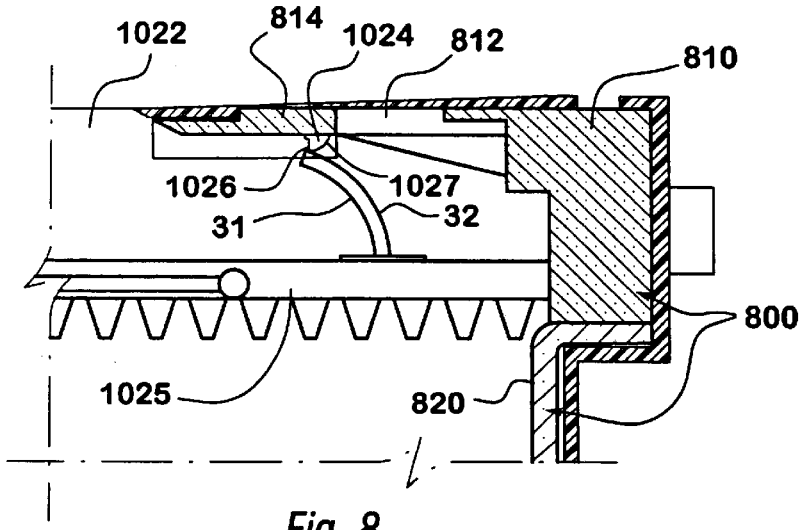
FIG. 8 is a plan perspective view of the cover for the maintenance station of FIG. 1, showing the wiper blade continuing its return pass under the ink absorbing material.
Figure 9:
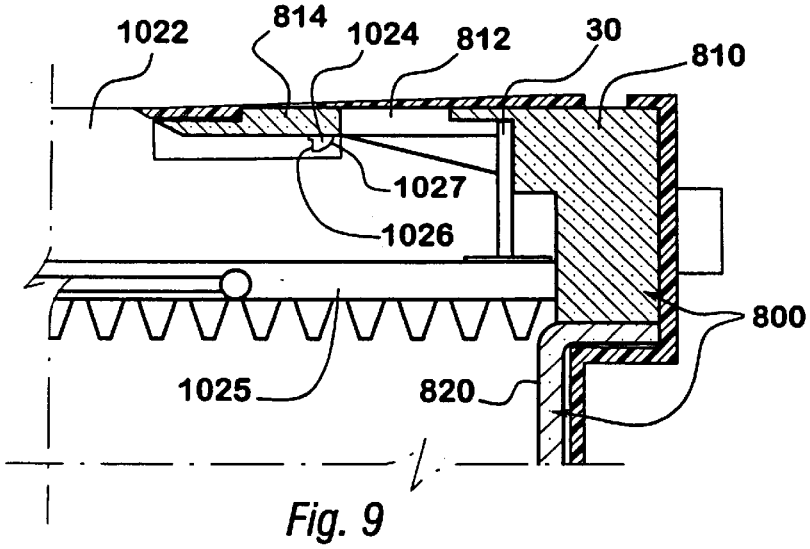
FIG. 9 is a plan perspective view of the cover for the maintenance station of FIG. 1, showing the wiper blade after completing its return pass under the ink absorbing material.

FIGS. 7–9 illustrate the interaction of the wiper blades 30 with the first portion 810 of the improved capacity ink blotter 800 as the wiper blade platform 1025 moves a final portion from the second position into the first position. As described above, when the one or more printheads are positioned adjacent to the maintenance station 1000, the one or more printhead nozzle faces 23 are located facing the opening 122 in the top cover 1020 of the maintenance station 100. With the one or more printheads 12 in this position, the printer controller 40 activates the maintenance station drive train to move the wiper blade platform 1025 from the first position, as shown in FIG. 9, to the second position, as shown in FIG. 4. As the wiper blade platform 1025 moves from the first position to the second position, the wiper blades 30 move past the leading portion 814 of the first portion 810 of the improved capacity ink blotter 800. In particular, the wiper blades 30 contact the scraper bar 1024 of the cover portion 1020 of the maintenance station 100. The wiper blades 30 then move across the leading portion 814, which removes any ink or either debris which may have become cluttered on the first surface 31 of the wiper blades 30.

Then, after all the maintenance function have been performed on the one or more printheads 12, the printer controller 40 again activates the maintenance station gear train and drive motor to move the cam shaft 100 from the extreme counterclockwise position to the extreme clockwise position. As described above, this eventually causes the wiper blade platform to move from the second position, as shown in FIG. 4, to the first position, as shown in FIG. 9.

As shown in FIG. 7, as the wiper blade platform 1025 moves from the second position to the first position, second surfaces 32 of the wiper blades 30 move across the printhead nozzle faces 23 to collect any liquid ink and other debris that has collected on the printhead nozzle faces 23. The wiper blades 30 then move out of the opening 1022, where the wiper blades contact the printhead nozzle faces 23 into contact with the leading portion 814 of the first portion 810 of the improved capacity ink blotter 800, as shown in FIG. 7. As the second surfaces 32 of the wiper blades 30 contact the leading portion 814, the wiper blades 30 bend back towards the opening 1022. As a result, any liquid ink collected on the second surfaces 32 of the wiper blades 30 is wicked in or absorbed by the leading portion 814. In addition, the friction between the leading portion 814 and the second surfaces 32 of the wiper blades 30 dislodges any nonliquid material from the second surfaces of the wiper blades 30.

Then, as shown in FIG. 8, as the wiper blade platform 1025 moves further from the second position to the first position, the second surfaces 32 of the wiper blades 30 contact the scraper bar 1024 of the cover portion 1020 of the maintenance station 1000. The scraper bar 1024 scrapes against the second surfaces 32 of the wiper blades 30 to remove any excess ink or particulate debris. Because the wiper blades 30 are formed from a resilient material, as the wiper blades 30 are bent by the leading portion 814 and the scraper bar 1024, as the wiper blade platform 1025 enters the full first position, the wiper blades 30 disengage from the leading portion 814 and/or the scraper bar 1024 and spring back into the openings 812 and into the recesses 816 formed in the first portion 810 of the improved capacity ink blotter 800. In particular, in the openings 812 and the recesses 816, the wiper blades 30 are not bent. As a result, a permanent plastic deformation of the resilient material forming the wiper blades 30 does not occur when the wiper blades 30 are in the first, or storage, position.

While this invention has been described with specific embodiments thereof, it is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention.

What is claimed is:

1. An ink blotter usable in a maintenance station of an ink jet printer having at least one printhead, the maintenance station having at least one wiper blade translatably positioned to remove waste ink and debris from the at least one printhead, the ink blotter comprising:

a first section of absorbent material positioned to absorb waste ink from the at least one wiper blade wherein the first section of absorbent material, further includes a rigid porous material that contacts each wiper blade as each wiper blade translates and removes waste ink and debris from each printhead; and a second section of absorbent material positioned adjacent to and in contact with the first section of absorbent material.

2. The ink blotter of claim 1, wherein the second section of absorbent material is partially split into at least two trailing sections, each trailing section increasing absorbency of the second section.

3. The ink blotter of claim 2, wherein each trailing section increasing absorbency of the second section through greater capillary action.

4. The ink blotter usable in a maintenance station of claim 1, wherein each wiper blade translation, comprises:

a second position, underneath a cover portion and opposite from the first section of absorbent material; and a first position adjacent to the first section of absorbent material.

5. The ink blotter usable in a maintenance station of claim 1, wherein a scraper bar providing a contact section for each wiper blade, such that the leading edge of each wiper blade is biased against the scraper bar, as each wiper blade is moved against and under the scraper bar, and the trailing edge of each wiper blade is biased against the scraper bar as each wiper blade reciprocates.

6. The ink blotter usable in a maintenance station of claim 5, wherein the first section of absorbent material contacts each wiper blade before and after the scraper bar is contacted.

7. The ink blotter usable in a maintenance station of claim 6, wherein each wiper blade is biased against the scraper bar, subsequently passes under the scraper bar and returns to a substantially undeformed state, directing removed ink and debris towards a rear portion of the first absorbent section, as each wiper blade is moved from the second position to the first position.

8. The ink blotter usable in a maintenance station of claim 6, wherein the removed ink and debris collect on a side wall portion of the maintenance station, travel down the side wall portion, and are absorbed by a spittoon portion of the second absorbent section.

9. A method of using the ink blotter of claim 1, comprising:

collecting waste fluid ink within the first and second absorbent sections; and providing the waste fluid ink received by the ink blotter system the ability to migrate down through the second absorbent section to increase the evaporative cycle and allow additional absorption.

10. A method for using the ink blotter of claim 1, comprising:

positioning a first section of absorbent material to absorb waste ink from the at least one wiper blade; and positioning a second section of absorbent material adjacent to and in contact with the first section of absorbent material.

11. The method of claim 10, wherein the second section of absorbent material further comprises being partially split into at least two trailing sections, each trailing section increasing absorbency of the second section.

12. The method of claim 10, wherein the first section of absorbent material, further includes a rigid porous material being in contact with each wiper blade as each wiper blade translates and removes waste ink and debris from each printhead.

13. The method of claim 12, wherein the first and the second sections of absorbent material being resiliently compressible along a common interface, further include a fluid flow path from the first section to the second section.

14. The method of claim 12, further includes attaching a pivotably attachable frame to provide a compression force, through the first and second sections of absorbent material, along the common interface.

15. The method of claim 14, wherein the compression force through the first and second sections of absorbent material, further includes the second section being split into the at least two trailing sections, and the second section having at least one opening, increases capillary action.

16. The method of claim 15, wherein the compression force through the first and second sections of absorbent material, further includes preventing saturation of the first section of absorbent material.

17. The method of claim 16, wherein the pivotably attachable frame further includes securing, a bar, wherein the bar securely holds the first section of absorbent material to the pivotably attachable frame and provides a contact section for each wiper blade.

18. The method of claim 17, wherein the bar providing a contact section for each wiper, such that the leading edge of each wiper blade is biased against the bar, further including, moving each wiper blade against and under the scrapper bar, and the trailing edge of each wiper blade being biased against the bar as each wiper blade reciprocates.

19. The method of claim 18, further including placing the first section of absorbent material in contact with each wiper blade before and after the bar contact section.

20. The method of claim 19, wherein each wiper blade translation, further comprises:

designating a second position, underneath the pivotably attachable frame and opposite from the first section of absorbent material; and designating a first position adjacent to the first section of absorbent material, wherein each wiper blade being biased against the bar, subsequently passing under the bar and returning to a substantially undeformed state, directing removed ink and debris towards a rear portion of the first absorbent section, as each wiper blade is moving from the second position to the first position.

* * * * *